United States Patent [19]

Van Wagener et al.

[11] Patent Number: 4,937,547

[45] Date of Patent: Jun. 26, 1990

[54] SHUNT RETAINING CLIP IN A BALLAST

[75] Inventors: Raymond H. Van Wagener, Darien, Conn.; Thomas Ruggiero, North Haledon, N.J.

[73] Assignee: Magnetek Universal Manufacturing Corp., Paterson, N.J.

[21] Appl. No.: 449,702

[22] Filed: Dec. 11, 1989

[51] Int. Cl.[5] ..... H01F 27/26

[52] U.S. Cl. ..... 336/160; 336/210; 336/212

[58] Field of Search ..... 336/210, 212, 160, 165; 361/377; 174/DIG. 2

[56] References Cited

U.S. PATENT DOCUMENTS

| | | | |
|---|---|---|---|
| 3,010,050 | 11/1961 | Hume et al. | 336/165 X |
| 3,371,301 | 2/1968 | Higano | 336/210 X |
| 4,800,357 | 1/1989 | Nickels, Jr. et al. | 336/210 X |
| 4,857,876 | 8/1989 | Costa | 336/210 X |

*Primary Examiner*—Thomas J. Kozma
*Attorney, Agent, or Firm*—Darby & Darby

[57] ABSTRACT

A ballast assembly for a fluorescent lighting fixture has a magnetic core, a primary winding and a secondary winding, both windings mounted on a central leg of the core, with a shunt disposed between the windings to prevent a flux generated by the primary winding from coupling with the flux generated by the secondary winding. The ballast further includes a shunt retaining clip disposable between the windings, the clip including a essentially U-shaped wall having a pair of upright portions and a crossover portion, a bottom ledge attached to the crossover portion for accepting the shunt. A spring arm extends between the pair of upright wall portions of the U-shaped wall with the spring arm sized to resiliently engage a top surface of the central core leg. By resiliently engaging the top surface, the clip and the shunt positioned thereon are accurately located relative to the central core thereby assuring long-term stability of the shunt, increasing efficiency and eliminating inconsistencies in magnetic flux concentration from ballast to ballast.

8 Claims, 1 Drawing Sheet

FIG. 1
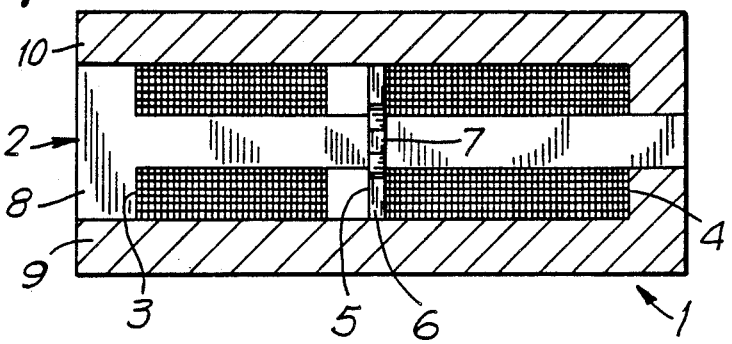
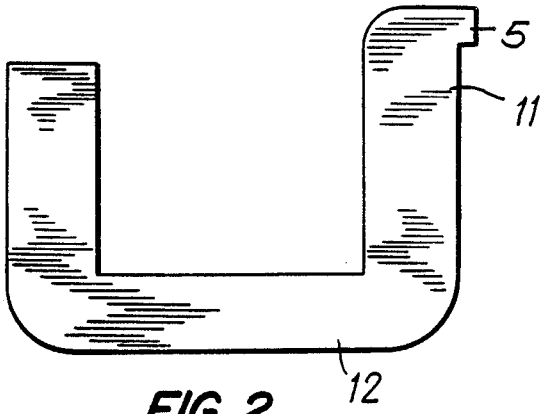
FIG. 2
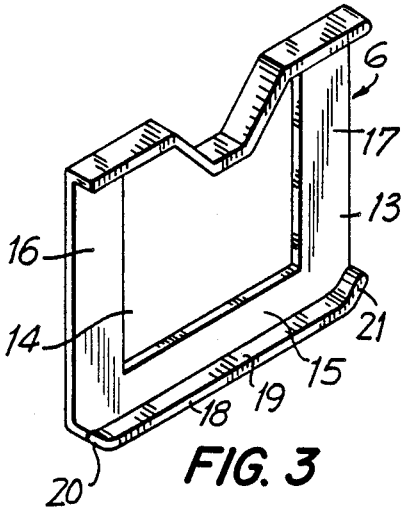
FIG. 3
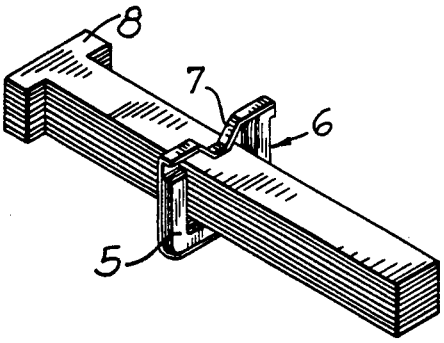
FIG. 4

SHUNT RETAINING CLIP IN A BALLAST

TECHNICAL FIELD

This invention relates to means for accurately mounting a shunt in a ballast assembly.

BACKGROUND OF THE INVENTION

A fluorescent lamp fixture requires a ballast for providing the starting and operating current to one or more fluorescent lamps. These ballasts utilize a transformer, having a magnetic core and a coil assembly. The magnetic core is usually laminated, i.e., made up of a number of thin ferromagnetic plates insulated from one another. The coil assembly usually includes a pair of coils, commonly referred to as a primary and a secondary winding, with each winding formed by winding a magnet wire on a spool or bobbin made from plastic or some other insulating material. The windings are disposed on a central leg of the magnetic core with each bobbin having a hollow center for fitting onto the central core leg. Two outside core legs are added to surround the windings to maximize flux concentration. During transformation, energy is transferred from the primary winding to the secondary winding by electromagnetic induction.

Ballast transformers may include one or more ferromagnetic shunts positioned between the primary and secondary windings. Such shunts increase the leakage reactance of the transformer by providing a flux leakage path between the primary and secondary windings. This flux leakage path is controlled by the air gap between the shunt and the core legs. The shunt, therefore, diverts a portion of the magnetic flux generated by the primary winding to prevent coupling with the flux generated by the secondary winding. Shunted transformers also limit the short-circuit current to a greater degree that those transformers that do not include such shunts, with the current reduction varying with the spacing (air gap) between the shunt and the adjacent core.

A fixed shunt method is typically used to incorporate a shunt in a ballast core. With this method, the shunt is integrally formed with the outside or inside legs of a ballast core, and, thus, by proper sizing maintains the appropriate air gap. However, this method is costly due to the large amount of scrap generated during stamping of the leg laminations which include the shunt portions.

Another method utilizes a U-shaped shunt, composed of a plurality of planar ferromagnetic laminations, which is inserted between the windings, with the upright legs of the shunt wrapped with tape to provide a snug fit between the center and end core legs. The shunt laminations may be held together by the tape, or may be bound with adhesives or fasteners. The thickness of the tape determines the gap between the shunt and the core, with compression of the tape maintaining the proper gap over the life of the ballast. This method avoids the large generation of scrap associated with the fixed shunt method.

A problem with this method for including separate shunts in ballasts is that with time, the tape may deteriorate or cold flow, allowing the shunt to shift position. Not only does this alter the short-circuit current, but in typical ballast transformers used for electrical lighting, the shunt may vibrate, causing a low-level hum which is considered a nuisance.

Another problem is proper positioning of the lower crossover portion of the U-shaped shunt relative to the central core leg. In high reactance type ballast assemblies, slight changes in positioning of the shunt cross over portion, on the order of 10–15 thousands, can have a major impact on performance characteristics. Consequently, shifting of the shunt has resulted in inconsistent performance, ballast to ballast, with increased failures during performance testing.

SUMMARY OF THE INVENTION

It is an object of the present invention to provide means for securing a shunt in a ballast assembly with or without tape.

It is a further object of the present invention to provide means for securing a shunt in a ballast assembly with long-term stability.

It is a further object of the present invention to provide means for securing a shunt in a ballast assembly accurately to avoid disturbances of the magnetic flux over time.

It is a further object of the present invention to provide means for securing a shunt in a ballast assembly accurately without requiring any labor-intensive operation, while realizing the cost advantages over the fixed shunt method.

According to the present invention, a ballast assembly has a magnetic core, a primary winding and a secondary winding, both windings placed on a leg of the core, with at least one shunt mounted between the windings. The ballast assembly further has means for accurately mounting the shunt in the assembly with or without tape, with the means comprising a shunt retaining clip having a first wall being in the shape of a "U" and having an opening in the center thereof corresponding to the size of the central core leg. The clip has a bottom ledge, of a width sufficient to support the shunt thereon, and spring means disposed between the upright legs of the U-shaped wall, the spring means engageable with a top of the central core leg for firmly retaining the clip in the assembly. A shunt is mounted on the bottom ledge of the clip with the clip and shunt then insertable onto the central core leg. Since the clip retains the shunt and the clip is restrained through engagement of the spring arm with the central core leg, accurate positioning of the shunt cross over portion is achieved and long-term stability is assured. Such a clip may be made from a relatively inexpensive plastic material.

BRIEF DESCRIPTION OF THE DRAWINGS

FIG. 1 is a cross-sectional view of a typical ballast assembly having primary and secondary windings with a separate U-shaped shunt disposed therebetween.

FIG. 2 is an enlarged view of a U-shaped shunt.

FIG. 3 is an enlarged view of the shunt retaining clip of the present invention.

FIG. 4 is an enlarged sectional view of the shunt retaining clip having a shunt disposed therein and located over a central leg of a core.

DETAILED DESCRIPTION OF THE INVENTION

Referring to FIG. 1, a ballast assembly is shown, in cross-section. Generally, the ballast assembly 1 includes a magnetic core 2, a primary winding 3 and a seconding winding 4, with a shunt 5 placed between the windings. The shunt is mounted on a shunt retaining clip 6, having a spring arm 7 at a top end thereof. The core 2 includes a T-shaped central leg 8 and first and second L-shaped legs, 9 and 10 respectively, with these legs formed from a plurality of ferromagnetic laminations. End core clamps (not shown) hold the laminations in place.

The windings 3 and 4 are manufactured by winding a magnet wire about a tube or a bobbin, having a hollow center sized to slip over the central leg 8. To produce the assembly, the primary winding 3 is slipped onto the T-shaped leg 8, then the clip 6 with the shunt 5 is placed on the leg 8, and the secondary winding 4 then slipped onto the leg. The L-shaped legs, 9 and 10, are then added to complete the core 2. While a ballast transformer, including T- and L-shaped laminations, is disclosed, it will be understood by those skilled in the art that many other transformer configurations could benefit from the present invention.

Referring to FIG. 2, an enlarged view of the U-shaped shunt 5 is shown. The shunt 5 is made up of a plurality of ferromagnetic laminations, which may be staked, welded or adhesively retained as a stack. The shunt is U-shaped, having upright portions 11 and a cross over portion 12.

Referring to FIG. 3, the shunt-retaining clip 6 is shown in a perspective view. The clip 6 has a wall 13 and a central opening 14 sized to admit a leg of the core therein. The wall 13 is essentially U-shaped having a bottom portion 15 and a pair of upright portions 16 and 17. The clip also includes a ledge 18 which includes a flat portion 19 and a pair of curved end portions 20 and 21. The ledge is essentially sized to accept the cross over portion of the shunt thereon. The width of the ledge may vary depending on the number of shunt laminations assembled to make the shunt stack. In a preferred embodiment, the curved end portions may be shaped to match the shunt, and located in such a way to assure a close fit. Thus, the bottom ledge cradles the shunt.

The clip is preferably composed of a non-magnetic material, and preferably composed of a plastic material such as nylon or polypropylene, providing sufficient strength to hold the shunts without requiring excessive costs in manufacture. Of course, other materials could be used just as effectively, balancing the consideration of strength and cost.

The clip 6 has the spring arm 7 extending between the upright portions 16 and 17 of the clip wall 13. The spring arm includes a portion curved inwardly in an amount sufficient to engage a top surface of a core leg and to thus bias the clip in an upward direction. This assures that the bottom wall of the clip is level and in engagement with a bottom surface of the core leg. Thus, the shunt resting on the bottom ledge is accurately pulled into position relative to the core. This assures consistent positioning of the cross over portion from ballast to ballast, which is particularly useful in high reactance ballasts. Such a spring arm also accommodates a range of stack heights of the core laminations, making the clip adaptable to various ballast constructions.

In this embodiment, the spring arm is integrally formed with the wall portions, with the clip material, whether nylon, polypropylene or another plastic, usually having sufficient resilience to assure long term stability.

To produce the ballast assembly requires manually or automatically placing the U-shaped shunt onto the shunt retaining clip. The clip is then positioned on the central core leg with the wall 13 placed adjacent to either the primary or secondary winding. If desired, the clip could be placed in contact with an end wall of the winding. This is accomplished by simply slipping the clip and shunt onto the central core leg. FIG. 4 shows the clip and shunt mounted on the central leg. The shunt may be retained on the clip using various means. For example, taping of the shunt to the clip.

Utilizing a shunt retaining clip for mounting shunts on the central core leg provides accurate and consistent mounting of the shunt within the ballast assembly. Consequently, variations in magnetic flux between units and the potential for movement due to vibration is essentially eliminated. Thus, shunt installation is simplified and uniform shunt positioning is assured from ballast to ballast. Also, since the clip may be readily mass produced at low cost, and requires simply placing the shunt on the clip prior to mounting on the core leg, means for automating ballast assembly may be possible, further reducing labor requirements. The shunt retaining clip also provides long-term shunt stability, eliminating the potential for shunt vibration and nuisance humming in fluorescent ballast assemblies.

While a shunt retaining clip including a wall and a ledge and a inwardly curved spring arm are disclosed, it will be understood by those skilled in the art that various other structures may be used for accurately mounting the shunt on a transformer without varying from the scope of the present invention.

We claim:

1. A ballast assembly having a magnetic core, a primary winding and a secondary winding, both windings mounted on a leg of the core, a shunt positioned between the windings, the assembly further comprising: a shunt retaining clip means placed between the primary and seconding windings for mounting the shunt in the ballast assembly, the clip means having a central opening for accepting the core leg core therein, and having a bottom ledge, the bottom ledge sized to accept a bottom of the shunt thereon, spring means integral with the clip means, the spring means resiliently engaged with the core leg, such that a bottom portion of the clip means is in engagement with a bottom surface of the core leg.

2. The ballast assembly of claim 1 wherein the clip means comprises a U-shaped wall having two upright portions and a bottom crossover portion, a bottom ledge extending perpendicular to the bottom crossover portion.

3. The ballast assembly of claim 1 wherein the spring means comprise an inwardly curved portion of the clip means for biasing the clip means against the core leg.

4. The ballast assembly of claim 1 wherein the bottom ledge has a pair of curved end portions shaped complimentary to the shunt.

5. The ballast assembly of claim 1 wherein the bottom ledge width corresponds substantially to the thickness of the shunt.

6. The ballast assembly of claim 1 wherein the clip means is composed of a non-magnetic material.

7. The ballast assembly of claim 1 wherein the clip means is composed of polypropylene.

8. The ballast assembly of claim 1 wherein the clip means is composed of nylon.

* * * * *